US007832018B2

(12) United States Patent
Schwarz

(10) Patent No.: US 7,832,018 B2
(45) Date of Patent: Nov. 16, 2010

(54) CAMOUFLAGE SUIT

(75) Inventor: René Schwarz, Bonstetten (CH)

(73) Assignee: SSZ Camouflage Technology AG, Zug (CH)

( * ) Notice: Subject to any disclaimer, the term of this patent is extended or adjusted under 35 U.S.C. 154(b) by 480 days.

(21) Appl. No.: 11/875,257

(22) Filed: Oct. 19, 2007

(65) Prior Publication Data

US 2008/0155729 A1 Jul. 3, 2008

(30) Foreign Application Priority Data

Oct. 20, 2006 (EP) ..... 06022010

(51) Int. Cl.
*A41D 13/00* (2006.01)
*A41D 13/02* (2006.01)

(52) U.S. Cl. ..... 2/69; 2/79; 2/900; 428/919

(58) Field of Classification Search ..... 2/69, 2/79, 900; 428/919, 544, 546, 548, 551, 428/615–618, 323, 328
See application file for complete search history.

(56) References Cited

U.S. PATENT DOCUMENTS

| | | | | |
|---|---|---|---|---|
| 5,281,460 | A * | 1/1994 | Cox | 428/112 |
| 6,127,007 | A * | 10/2000 | Cox et al. | 428/15 |
| 7,196,023 | B2 * | 3/2007 | Langley et al. | 442/131 |
| 7,344,661 | B2 * | 3/2008 | Kuehl | 252/582 |
| 7,412,937 | B2 * | 8/2008 | Stevens et al. | 112/475.08 |
| 7,415,934 | B2 * | 8/2008 | Takken | 112/475.08 |

FOREIGN PATENT DOCUMENTS

| | | |
|---|---|---|
| JP | 2005-335154 | 12/2005 |
| WO | WO 98/12494 | 3/1998 |

* cited by examiner

*Primary Examiner*—Gloria Hale
(74) *Attorney, Agent, or Firm*—Antonelli, Terry, Stout & Kraus, LLP.

(57) ABSTRACT

A camouflage suit for reducing the discoverability of persons in the visible and infrared spectrum, as for example the thermal infrared spectrum, exhibits a breath-active fabric exhibiting an open fabric structure based on a textile backing. The backing here exhibits a low-emitting surface. This can be achieved by at least partly sheathing or coating the textile backing with an electrically conductive material.

10 Claims, No Drawings

CAMOUFLAGE SUIT

TECHNICAL FIELD

The invention relates to a camouflage suit for reducing the discoverability of persons in the visible and infrared spectrum, such as for example the thermal infrared spectrum and a method for producing it.

BACKGROUND AND SUMMARY

Camouflage suits and combat suits used heretofore reduce the discoverability of the soldier in the visible and near infrared of the electromagnetic spectrum but have no action in the thermal infrared. Because of the greater and greater availability of thermal imaging devices, the soldier is increasingly unprotected against detection.

Offered as a solution are suits that reduce the signature in the thermal infrared, the overwhelming majority of these suits functioning by virtue of their construction. This means that these suits are constructed in three-dimensional fashion or exhibit a plurality of plies, as described for example in the patent application published as JP2005335154. What is described is a multi-ply laminate material exhibiting a base apparel fabric covered by a metal ply, which in turn is covered with a further resin ply. The publication WO98/12494 describes a three-dimensional camouflage material exhibiting a textile outer ply that covers a microporous membrane. This microporous membrane is partly equipped with an infrared-reflecting metal coating. Further, U.S. Pat. No. 6,127,007 describes an open fabric structure that is covered with a multiplicity of fabric strips that extend at least almost away from the open structure in freely movable fashion. These quasi-loose-hanging strips exhibit a low emission in order to ensure protection against recognition in the infrared region.

Further known are so-called pelerines, which once again exhibit a closed surface or outer skin, which are provided with a metal coating similarly to the Japanese patent application cited. Both the solution described in the Japanese publication and also the pelerines mentioned are not, however, very well suited for combat service.

It is therefore an object of the invention to propose a camouflage suit that can ensure at least partial protection against recognition even in the case of so-called thermal imaging devices.

The invention is achieved with a camouflage suit comprising a breath-active fabric exhibiting an open fabric structure based on a textile backing exhibiting at least in part a low-emitting surface, wherein the breath-active fabric is applied to or bonded by pointwise lamination to a textile fabric commonly used for outdoor apparel or work apparel.

DETAILED DESCRIPTION OF EMBODIMENT

What is proposed is a camouflage suit for reducing the discoverability of persons in the visible and infrared spectrum, as in particular the thermal infrared spectrum, exhibiting a breath-active fabric having an open fabric structure based on a textile backing, which exhibits at least in part a low-emitting surface. The proposed suit reduces the thermal signature on the principle of the low-emitting surface. Further, the camouflage suit proposed according to the invention is breath-active and does not restrict the soldier in his mobility. In addition, it is also serviceable for combat in developed terrain.

According to a variant embodiment, the suit comprises an open fabric having a textile backing that is at least partly transformed with an electrically conductive material. This can be a metallic material such as for example copper, nickel or an appropriate alloy.

The textile backing, however, can also comprise a pure polyester, polyamide, polypropylene or blended fabric, at least partly sheathed with an electrically conductive material, such as provided with a metal coating.

It is further proposed that the fabric is printed in camouflage color.

This material is bonded to a standard textile, for example a cotton fabric or a cotton-polyester blended fabric, by pointwise lamination.

The emissivity of the finished fabric in the spectral range from for example 8 to 12 μm should be approximately 40 to 60%, such as for example approximately 50%. The printed, metalized fabric is employed as the outer side. Without textile printing, the emissivity is approximately 10%; after printing, the emissivity increases to approximately 50%. The metalizing of the raw fabric is effected for example chemically in a dip bath. As an alternative to chemical metalizing, the open fabric can also be physically metalized. Afterward, before printing, this is preferably coated with a polymer so that it can be printed. Care must be taken that the coating does not form a complete film on the fabric, reducing the passage of air and moisture too greatly.

Camouflage suits or combat suits proposed according to the invention can be constructed in a quite normal way from the fabric so produced.

Further preferred variant embodiments of the camouflage suit according to the invention are described below.

Further proposed is a method for producing a camouflage suit according to the invention, the method comprising providing a filament for producing the breath-active fabric, coating the filament with an electrically conductive coating, and then weaving the coated filament to produce the textile, breath-active fabric, and including providing the breath-active fabric with a camouflage color by one of coloring the filament to be woven and coloring the fabric woven from the filament. According to a variant embodiment it is proposed that first a filament, such as for example a cotton filament, a filament of a polymer material such as polyester, polyamide, polypropylene or a blended fabric, is metalized first and then woven in order to produce the camouflage fabric. The filament can be dyed before construction or metalizing or, however, the camouflage fabric produced according to the invention can be printed with a camouflage color afterward.

Alternatively, however, it is also possible to produce the open camouflage fabric first and then metalize it at least almost completely. Suitable here are, on the one hand, chemical treatment with a dip bath or, however, physical application of the metallic coating by spraying, sinter-fusing, application with a doctor blade, etc.

The production of a camouflage suit according to the invention is effected finally by application of the camouflage fabric to for example a cotton fabric or cotton-polyester blended fabric, as commonly employed, for example for conventional combat suits, work apparel, etc. The application of the camouflage fabric here is effected for example by pointwise lamination, that is, with the use of a hot-melt adhesive applied pointwise to one or the other fabric, as commonly used for example in textile construction, followed by compression. Pointwise lamination makes it possible for the final camouflage suit to be breath-active. According to an exemplary embodiment, approximately 100 g/m$^2$ of camouflage fabric and approximately 100 g/m$^2$ of textile fabric are employed for producing the camouflage suit according to the invention. Naturally, other weight ratios are possible in dependence on the application.

The invention claimed is:

1. A breath-active camouflage suit for reducing the discoverability of a person in the visible spectrum, and in the thermal infrared spectrum, the camouflage suit comprising a textile, breath-active fabric constructed as a camouflage suit having a camouflage coloring, the breath-active fabric exhibiting an open fabric structure based on a textile backing exhibiting at least in part a low-emitting surface which reduces a thermal infrared signature of the suit, wherein the breath-active fabric comprises an open fabric having said textile backing, which is at least partly sheathed with an electrically conductive material.

2. The camouflage suit of claim 1, wherein the textile backing is at least partly sheathed with a metallic material selected from the group consisting of copper, nickel and an electrically conductive metal alloy.

3. The camouflage suit of claim 1, wherein the breath-active fabric is printed in camouflage color to provide said camouflage coloring.

4. The camouflage suit of claim 1, wherein the breath active fabric is applied to or bonded by pointwise lamination to a textile fabric selected from the group consisting of a fabric of cotton and a cotton-polyester blended fabric.

5. The camouflage suit of claim 1, wherein the textile backing is selected from the group consisting of polyester, polyamide, polypropylene and a blended fabric.

6. The camouflage suit of claim 1, wherein an emissivity of the fabric of the camouflage suit in the spectral range from 8 to 12 μm is approximately 40 to 60%.

7. A method for producing a breath-active camouflage suit for reducing the discoverability of a person in the visible spectrum and in the thermal infrared spectrum, the camouflage suit comprising a textile, breath-active fabric constructed as a camouflage suit having a camouflage coloring, the breath-active fabric exhibiting an open fabric structure based on a textile backing exhibiting at least in part a low emitting surface which reduces a thermal infrared signature of the suit, wherein the breath-active fabric comprises an open fabric having said textile backing, which is at leastly partly sheathed with an electrically conductive material, the method comprising:

providing at least part of a textile backing fabric for the breath-active fabric with an electrically conductive metallic coating as said electrically conductive material by a process selected from the group consisting of chemical coating with a dip bath, spraying, and application with a doctor, and providing the fabric with a camouflage coloring after coating.

8. A method for producing a breath-active camouflage suit for reducing the discoverability of a person in the visible spectrum and in the thermal infrared spectrum, the camouflage suit comprising a textile, breath-active fabric constructed as a camouflage suit having a camouflage coloring, the breath-active fabric exhibiting an open fabric structure based on a textile backing exhibiting at least in part a low emitting surface which reduces a thermal infrared signature of the suit, wherein the breath-active fabric comprises an open fabric having said textile backing, which is at leastly partly sheathed with an electrically conductive material, the method comprising:

providing a filament for producing the textile, breathe-active fabric, coating the filament with an electrically conductive coating as said electrically conductive material, and then weaving the coated filament to produce the breath-active fabric, and including providing the breath-active fabric with a camouflage coloring by one of coloring the filament to be woven and coloring the fabric woven from the filament.

9. The method of claim 8, including bonding the breath-active fabric by pointwise lamination with a textile fabric selected from the group consisting of a cotton fabric and a cotton-polyester blended fabric.

10. The method of claim 7, including bonding the breath-active fabric by pointwise lamination with a textile fabric selected from the group consisting of a cotton fabric and a cotton-polyester blended fabric.

* * * * *